US008261920B1

(12) United States Patent
Matthews

(10) Patent No.: US 8,261,920 B1
(45) Date of Patent: Sep. 11, 2012

(54) PORTABLE SHELF UNIT SUPPORTED BY A TOWEL BAR

(75) Inventor: Loren Michael Matthews, Fort Lauderdale, FL (US)

(73) Assignee: Zoya, Inc., Fort Lauderdale, FL (US)

( * ) Notice: Subject to any disclaimer, the term of this patent is extended or adjusted under 35 U.S.C. 154(b) by 37 days.

(21) Appl. No.: 12/798,232

(22) Filed: Mar. 31, 2010

(51) Int. Cl.
*A47F 5/08* (2006.01)
*A47B 23/00* (2006.01)

(52) U.S. Cl. ..... 211/90.01; 108/42

(58) Field of Classification Search ..... 211/90.01, 211/90.02, 6, 16, 88.04, 193, 106, 87.01, 211/133.6, 134, 119.009, 119.011, 90.03, 211/88.01, 119.003; 108/42, 152, 50.11; 248/214

See application file for complete search history.

(56) References Cited

U.S. PATENT DOCUMENTS

| | | | | | |
|---|---|---|---|---|---|
| 560,884 | A | * | 5/1896 | Anderson et al. | 248/249 |
| 883,323 | A | * | 3/1908 | Macduff | 248/250 |
| 1,258,792 | A | * | 3/1918 | Lorimer | 220/23.83 |
| 1,558,977 | A | * | 10/1925 | Gray | 248/208 |
| 1,730,345 | A | * | 10/1929 | Beman | 211/74 |
| 1,809,216 | A | * | 6/1931 | Quandt | 248/208 |
| 1,986,935 | A | * | 1/1935 | Levine | 248/213.2 |
| 2,003,241 | A | * | 5/1935 | Brown | 248/439 |
| 2,014,745 | A | * | 9/1935 | Regli | 108/11 |
| 2,049,386 | A | * | 7/1936 | Temperli | 108/11 |
| 2,258,178 | A | * | 10/1941 | Haffner | 108/29 |
| 2,612,273 | A | * | 9/1952 | Smith | 211/119.009 |
| 2,647,641 | A | * | 8/1953 | Tritt | 211/88.04 |
| 2,659,491 | A | * | 11/1953 | Williams | 211/119.011 |
| 2,680,523 | A | * | 6/1954 | Heeter | 108/44 |
| 3,096,731 | A | * | 7/1963 | Lehman | 108/29 |
| 3,186,673 | A | * | 6/1965 | Olson | 248/309.4 |
| 3,243,048 | A | * | 3/1966 | Lang | 211/74 |
| 3,339,994 | A | * | 9/1967 | Reddig et al. | 312/301 |
| 3,400,829 | A | * | 9/1968 | Youngson | 211/119.006 |
| 3,524,553 | A | * | 8/1970 | Zitmore | 211/126.2 |
| 3,612,590 | A | * | 10/1971 | Andreini et al. | 292/76 |
| 3,814,367 | A | * | 6/1974 | Rasmussen | 248/311.2 |
| 4,181,382 | A | * | 1/1980 | Harvey | 312/245 |
| 4,233,911 | A | | 11/1980 | Vignale | |
| D266,827 | S | * | 11/1982 | Withrow | D8/373 |
| 4,357,881 | A | * | 11/1982 | De Long | 108/49 |
| D274,486 | S | * | 7/1984 | Thompson | D6/525 |
| 4,799,432 | A | * | 1/1989 | Rickner | 108/42 |
| 4,827,849 | A | | 5/1989 | Vignale | |
| 4,870,907 | A | | 10/1989 | McKee | |
| 4,901,871 | A | * | 2/1990 | Ohm et al. | 211/119.004 |
| D311,828 | S | * | 11/1990 | Clark et al. | D6/406.5 |
| 5,062,674 | A | * | 11/1991 | Magee | 294/143 |
| 5,169,010 | A | * | 12/1992 | Fortner | 211/86.01 |
| 5,181,621 | A | * | 1/1993 | Plaehn | 211/88.01 |
| 5,433,152 | A | | 7/1995 | Henry | |
| 5,715,957 | A | * | 2/1998 | Merl | 211/187 |
| 5,890,605 | A | * | 4/1999 | Percudani | 211/87.01 |
| 5,921,410 | A | * | 7/1999 | Emery et al. | 211/88.01 |
| 6,244,448 | B1 | * | 6/2001 | Hang | 211/105.1 |
| 6,561,364 | B1 | | 5/2003 | Brunsden | |
| 6,866,157 | B2 | * | 3/2005 | Shone | 211/90.03 |
| 2008/0308512 | A1 | * | 12/2008 | Knepfle | 211/119.009 |

* cited by examiner

*Primary Examiner* — Darnell Jayne
*Assistant Examiner* — Kimberly S Wright
(74) *Attorney, Agent, or Firm* — Ronald V. Davidge

(57) ABSTRACT

A shelf unit configured to be supported between a towel bar and a wall includes a tray and an end bracket extending downward adjacent each end edge of the tray. Each of the end brackets includes a mounting block and a spring extending forward from the end block to engage the towel bar.

19 Claims, 2 Drawing Sheets

PORTABLE SHELF UNIT SUPPORTED BY A TOWEL BAR

RELATED APPLICATIONS

Not Applicable

FEDERALLY SPONSORED RESEARCH OR DEVELOPMENT

Not Applicable

BACKGROUND OF THE INVENTION

1. Field of the Invention

This invention relates to a shelf, and, more particularly, to a portable shelf that is held in place by a towel bar.

2. Summary of the Background Information

Since individuals and families place widely variable demands regarding storage space for soaps, cosmetics, appliances, etc. that are frequently used in a bathroom, it is often difficult, during the design and construction of the bathroom, to correctly anticipate the number and placement of shelves that will eventually be needed. Furthermore, there are many factors, such as the aging of children into teenagers that have increased needs for such bathroom items and the presence of guests needing storage space for their own bathroom items, that place variable demands on bathroom shelving. It is therefore desirable to provide a shelf unit that can be easily added to a bathroom, with the new shelf deriving physical support from the surface of a wall and from a towel bar extending the along the wall in a spaced-apart relationship with the wall. One problem that must be solved arises from the fact that the size and shape of the towel bar and the distance between the towel bar and the wall are not known. For example, a towel bar may be square, rectangular, or circular in cross-section, and a square bar may be held with a flat side facing upward or with a corner facing upward.

The patent literature includes a number of descriptions of such shelf units, each including a shelf extending between a pair or end brackets supported by a towel bar and an adjacent end surface. For example, the shelf may be supported by a pair of end brackets, each of which includes an oblique front surface extending downward from a point in front of the towel bar to a point closer to the wall, so that different towel bar configurations rest against the bracket at different points along their oblique surfaces. In another example, a shelf is formed by a plate extending above and between a pair of end brackets, each of which extends rearward to rest against the wall both above and below the towel bar. Each of the end brackets includes an angle bracket that is slidably mounted by a screw and wing nut to be adjusted so that a leg of the angle bracket is held against an inner surface of the towel bar, with the end bracket being held against the wall. In other shelf assemblies, the end brackets are notched to accept an upward facing corner of a square towel bar, with either a rear surface of the shelf or the rear surfaces of the end brackets being additionally attached to the wall.

SUMMARY OF THE INVENTION

In accordance with a first aspect of the invention, a shelf unit includes a tray and a pair of end brackets. The tray includes a front edge, a rear edge opposite the front edge, and a pair of end edges, opposite one another. Each of the end brackets includes a mounting block, additionally adjacent the rear edge of the tray, and a spring extending forward from the mounting block, being connected to the mounting block.

Preferably, the spring is spaced away from the tray, and is composed of a plurality of elongated inclined segments joined to one another, with segments extending forward and uward being disposed between segments extending forward and downward. Preferably, the spring extends from the mounting block to a free end, with an inclined elongated segment extending forward and upward being disposed at the free end. Preferably, each of the end brackets is formed as an integral part, being composed of a thermoplastic resin.

Preferably, the tray additionally includes a mounting structure extending downward adjacent each of the end edges and additionally adjacent the rear edge, with each of the mounting structures including a front surface, a rear surface, and a channel extending through the mounting block from the front surface to the rear surface. Each of the end brackets then additionally includes a rail sliding within the channel of one of the mounting structures.

BRIEF DESCRIPTION OF THE FIGURES

These and other aspects of the invention will be made apparent by reading the following specification in conjunction with the drawings, in which.

DETAILED DESCRIPTION OF THE INVENTION

Figure 1:
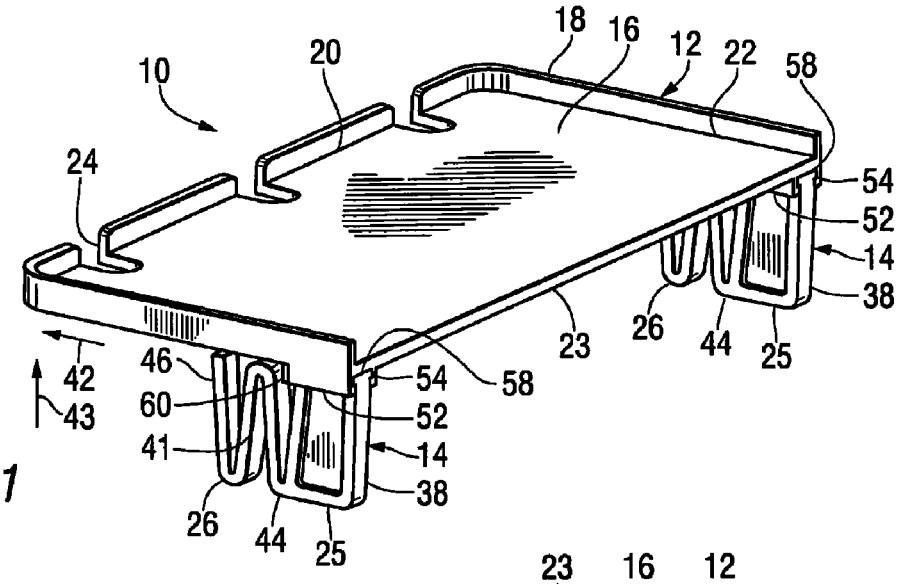
FIG. 1 is a perspective view of a shelf unit built in accordance with the invention.
Figure 2:
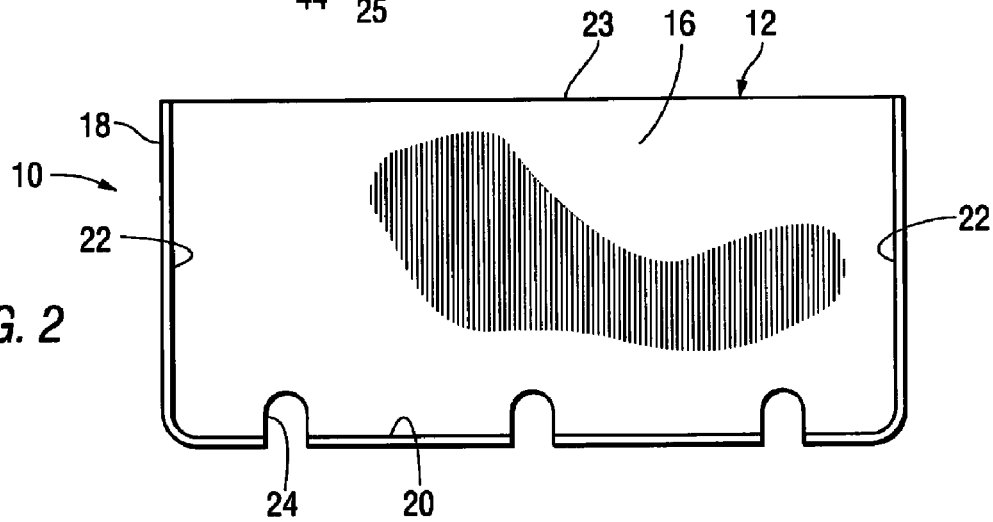
FIG. 2 is a plan view of the shelf unit of FIG. 1.
Figure 3:
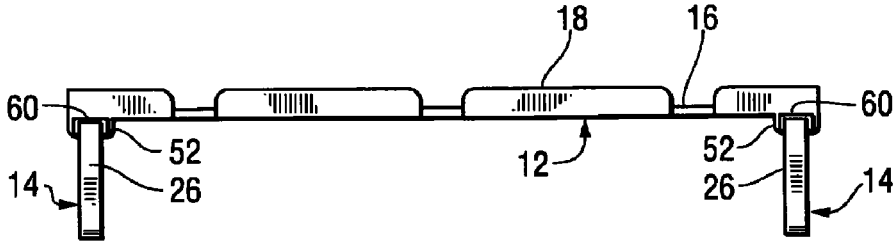
FIG. 3 is a front elevation of the shelf unit of FIG. 1.

FIG. 1 is a perspective view of a shelf unit 10 built in accordance with the invention, while FIG. 2 is a plan view thereof, and while FIG. 3 is a front view thereof. The shelf unit 10 includes a tray 12 supported by a pair of end brackets 14. The tray 12 includes a flat portion 16 with a lip 18 extending along a front edge 20 and along end edges 22. The tray 12 also includes a rear edge 23. Openings 24 are provided along the front edge 20 within the flat portion 16 and the lip 18 to provide places in which toothbrushes and razor handles (both not shown) may be hung. Each of the end brackets 14 includes a mounting block 25 and a spring 26.

Figure 4:
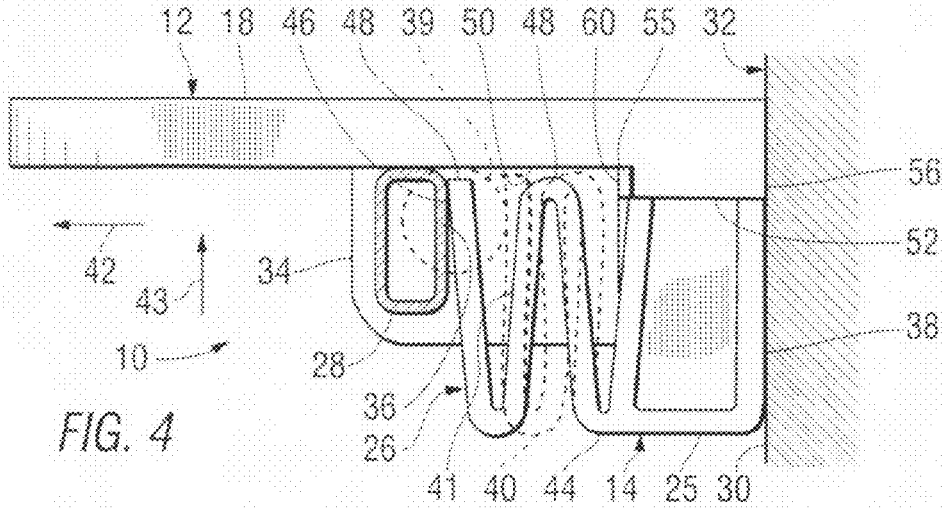
FIG. 4 is an end elevation of the shelf unit of FIG. 1, shown as installed to be supported by a towel bar and a wall surface.

FIG. 4 is an end elevation of the shelf unit 10, shown as installed to be supported by a towel bar 28 and a surface 30 of a wall 32, with both the towel bar 28 and the wall 32 being shown in cross-section. The towel bar 28 is connected to wall 32 by a number of support brackets 34. The spring 26 within each of the end brackets 14 is compressed by contact with an inner surface 36 of the towel bar 28 as the rear surfaces 38 of the support brackets 34 are held against the wall surface 30.

The springs 26 are configured to provide for use with a variety of towel bar shapes and with substantial variation in the space provided between the 28 and the wall surface 30. As shown in the example of FIG. 4, while the springs 26 are sufficiently compressed by contact with the towel bar 28 to hold the shelf unit 10 in place, alternative contact with a differently-shaped towel bar 39 merely causes the springs 26 to be further compressed as indicated by dashed lines 40.

For example, each of the springs 26 is composed of a plurality of elongated segments 41, joined to one another to extend forward, in the direction of arrow 42, from the mounting block 25 and alternately upward, in the direction of arrow 43, and downward, opposite the direction of arrow 43. Preferably each spring 26 is configured to be constrained only by its connection 44 to the mounting block 25, so that the free end 46 of the spring 26 can move freely between the position in which it is shown in contact with the towel bar 28 and the position in which it is indicated by dashed lines 40, with a clearance sufficient for such movement being provided between each upper surface 48 of the spring 26 and an adjacent lower surface 50 of the tray 12 Preferably, the elongated segment 41 at the free end 46 of the spring 26 extends forward and upward to facilitate moving the spring end bracket 14 into position between the wall 32 and the towel bar 28.

Preferably, each of the end brackets 14 is formed as an integral part by an injection molding process, being composed of a thermoplastic resin, with the tray 12 additionally being formed as an integral part in by injection molding process, being composed of a thermoplastic resin.

Figure 5:
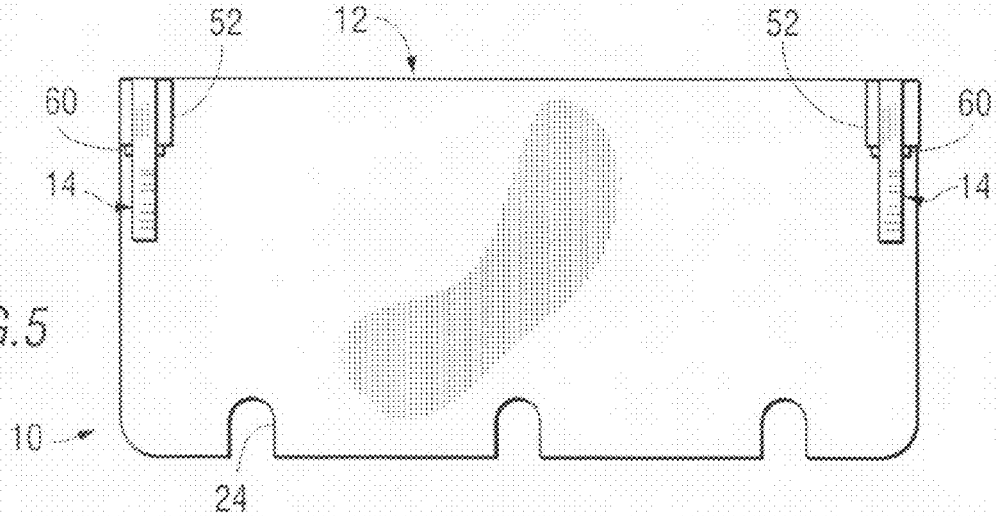
FIG. 5 is a bottom plan view of the shelf unit of FIG. 1.
Figure 6:
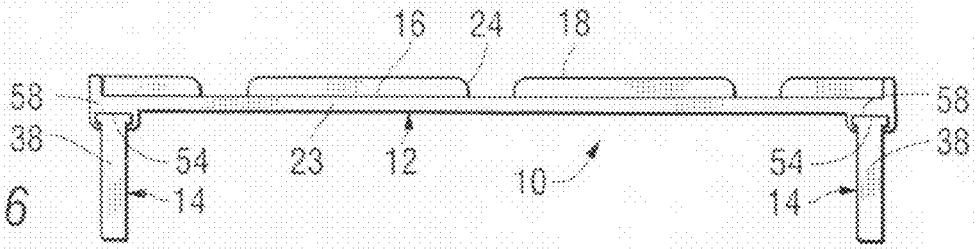
FIG. 6 is a rear elevation of the shelf unit of FIG. 1.

FIG. 5 is a rear elevation of the shelf unit 10, while FIG. 6 is a bottom plan view thereof. The tray 12 includes a mounting structure 52, extending downward from the flat portion 16 for the attachment of each of the end brackets 14. A channel 54 extends through each of the mounting structures 52 between a front surface 55 thereof and a rear surface 56 thereof. The mounting block 25 of each of the end brackets 14 includes a rail 58, sliding within the channel 54 in the direction of arrow 42, and an enlarged portion 60 at a front end of the rail 58, stopping this sliding motion when the rail 58 is fully engaged within the channel 54. With the end brackets 14 held between the towel rod 28 and the wall 32, the enlarged portions 60 prevent outward movement of the tray 12.

This construction allows the shelf unit 10 to be easily assembled, stored, and reassembled for later use. For example, the shelf unit 10 can be easily taken along on a trip for use in a hotel room not providing adequate shelf space.

While the invention has been described in terms of preferred embodiments with some degree of particularity, it is understood that this description has been given only by way of example, and that many changes can be made without departing from the spirit and scope of the invention, as defined in the appended claims.

What is claimed is:

1. A shelf unit configured for attachment to a towel bar spaced apart from a wall, comprising:

a tray including a front edge, a rear edge opposite the front edge, and a pair of end edges, opposite one another, and a pair of end brackets extending downward adjacent the end edges of the tray, wherein each of the end brackets includes a mounting block, a rear surface adjacent the rear edge of the tray, and a spring, formed as an integral part with the mounting block, wherein the mounting block extends forward from the rear surface, wherein the spring is connected to the mounting block, being constrained only by connection to the mounting block, and extending forward from the mounting block to a free end, and wherein the spring is configured so that the free end engages only a towel bar disposed beneath and against the tray while holding the rear surface of the mounting block held against the wall.

2. The shelf unit of claim 1, wherein the spring is spaced away from the tray.

3. The shelf unit of claim 1, wherein the spring is composed of a plurality of elongated inclined segments joined to one another, with segments extending forward and upward being disposed between segments extending forward and downward.

4. The shelf unit of claim 3, wherein the spring includes an inclined elongated segment extending forward and upward being disposed at the free end.

5. The shelf unit of claim 3, wherein the end brackets and springs are composed of a thermoplastic resin.

6. The shelf unit of claim 1, wherein the tray additionally includes a mounting structure extending downward adjacent each of the end edges and additionally adjacent the rear edge, each of the mounting structures includes a front surface, a rear surface, and a channel extending rearward through the mounting structure from the front surface to the rear surface of the mounting structure, and each of the end brackets additionally includes a rail sliding within the channel of one of the mounting structures.

7. The shelf unit of claim 6, wherein each of the mounting blocks additionally includes an enlarged section at a front end of the rail, and the enlarged sections each stop rearward movement of the rail within the channel by contacting the front surface of the mounting structure.

8. A shelf unit comprising:

a tray including a front edge, a rear edge opposite the front edge, a pair of end edges, opposite one another and perpendicular to the rear edge, and a mounting structure extending downward adjacent each of the end edges and additionally adjacent the rear edge, wherein each of the mounting structures includes a front surface, a rear surface, and a channel extending through the mounting structure from the front surface to the rear surface; and a pair of end brackets extending downward from adjacent the end edges of the tray, wherein each of the end brackets includes a rail sliding within the channel of one of the mounting structures in a direction perpendicular to the rear edge and an enlarged section at a front end of the rail, wherein the enlarged section stops movement of the rail within the channel by contacting the front surface of the mounting structure, wherein each of the end brackets additionally includes a mounting block and a spring formed as an integral part with the mounting block, connected to the mounting block to extend forward from the mounting block to a free end, being constrained only by connection to the mounting block, and wherein the spring is configured so that the free end engages only a towel bar disposed beneath and against the tray while holding the rear surface of the mounting block against a wall spaced apart from the towel bar.

9. The shelf unit of claim 8, wherein the spring is spaced away from the tray.

10. The shelf unit of claim 8, wherein the spring is composed of a plurality of elongated inclined segments joined to one another, with segments extending forward and upward being disposed between segments extending forward and downward.

11. The shelf unit of claim 8, wherein the spring includes an inclined elongated segment extending forward and upward to the free end.

12. The shelf unit of claim 7, wherein each of the end brackets and springs is composed of a thermoplastic resin.

13. The shelf unit of claim 7, wherein the tray is formed as an integral part, being composed of a thermoplastic resin.

14. Apparatus held on a towel bar attached to a wall, comprising:

the wall;

the towel bar;

a pair of towel bar brackets attached to the wall, holding the towel bar in a location spaced away from the wall;

a tray disposed above and against the towel bar to extend along the towel bar between ends of the tray; and an end bracket at each end of the tray, extending downward into a space between the towel bar and the wall, wherein each end bracket includes a mounting block attached to the tray and a spring extending forward from the mounting block, being formed as an integral part with the mounting block, having a free end engaging only the towel bar to hold the mounting block against the wall, and wherein the spring is constrained only by attachment to the mounting block and engagement with the towel bar.

15. The apparatus of claim 14, wherein the tray includes a mounting structure engaging each of the end brackets, with the mounting block of each end bracket being slidably attached to the mounting structure to move in a forward direction, away from the wall and perpendicular to the wall, and with each mounting block including a stopping surface limiting forward movement of the mounting structure along the mounting block.

16. The apparatus of claim 14, wherein each mounting structure includes a channel, extending perpendicular to the wall, and a front surface, each mounting block includes a rail, sliding within the channel of an adjacent mounting structure, and an enlarged section stopping movement of the rail within the channel by contacting the front surface of the adjacent mounting structure.

17. The shelf unit of claim 14, wherein the spring is composed of a plurality of elongated inclined segments joined to one another, with segments extending forward and upward being disposed between segments extending forward and downward.

18. The shelf unit of claim 14, wherein the spring includes an inclined elongated segment extending forward and upward to the free end.

19. The shelf unit of claim 17, wherein each of the end brackets and springs is composed of a thermoplastic resin.

* * * * *